United States Patent [19]

Schaeffer et al.

[11] 3,930,325

[45] Jan. 6, 1976

[54] STEAM IRON SOLEPLATE CONSTRUCTION

[75] Inventors: Robert L. Schaeffer, Brockport, N.Y.; Kaj Toft, Upland, Calif.

[73] Assignee: General Electric Company, Bridgeport, Conn.

[22] Filed: July 24, 1974

[21] Appl. No.: 491,463

[52] U.S. Cl. ..... 38/77.83

[51] Int. Cl.[2] ..... D06F 75/06; D06F 75/18

[58] Field of Search ..... 38/77.5, 77.8, 77.81, 77.82, 38/77.83, 77.9

[56] References Cited

UNITED STATES PATENTS

| | | | |
|---|---|---|---|
| 3,134,182 | 5/1964 | Morton | 38/77.9 |
| 3,165,844 | 1/1965 | Swanke | 38/77.83 |
| 3,735,507 | 8/1967 | Vicceli | 38/77.9 |
| 3,811,208 | 5/1974 | Vicceli et al. | 38/77.8 |

*Primary Examiner*—Geo. V. Larkin

*Attorney, Agent, or Firm*—John F. Cullen; George R. Powers; Leonard J. Platt

[57] ABSTRACT

A steam iron soleplate, generator, and distributor subassembly of a thin soleplate with a cover-plate spaced from and supported on the soleplate by spaced peripheral rib means to define a steam distributing passage therebetween. The coverplate is integrally attached to the soleplate by a continuous weld between the ribs and soleplate and steam generating means are provided in the upper surface of the coverplate separate and spaced from the soleplate and ducted below to the steam passage means. A heat generating element forms an integral part of the coverplate for heat transfer to the soleplate through the ribs primarily by conduction. Both the method of assembly and the subassembly itself are disclosed.

8 Claims, 3 Drawing Figures

STEAM IRON SOLEPLATE CONSTRUCTION

BACKGROUND OF THE INVENTION

1. Field of the Invention:

The invention herein pertains to a steam iron soleplate, generator, and steam distributor subassembly using inexpensive parts in an arrangement for easy cleaning and efficient conversion of all water to steam in a simplified arrangement that permits use of any number of soleplate surfaces.

2. Description of the Prior Art:

Recent designs in irons disclose simpler irons that may use plastic parts, may be used as clothes steamers as well as for ironing, are lighter weight, and that are intended to sell at a lower price. These irons use different constructions from the normal rather complex well-known constructions. Typically, such irons may employ the construction shown in U.S. Pat. Nos. 3,260,005 and 3,811,208 showing a soleplate subassembly and semi-plastic construction, respectively.

One of the difficulties in using relatively thin soleplates is applying the heating element to the soleplate without causing the soleplate to warp. Typically, this is not a problem in the normal heavy cast soleplate where the heating element is cast in the soleplate or is welded to it and the heavy soleplate provides a large heat sink and is sufficiently massive for machining of the surface afterward. Additionally, in steam irons it is necessary that the parts be effectively sealed because of the presence of water and the sealing compound applied between separable parts is itself often the source of trouble in creating dri-filming problems where the water tends to boil and bounce on the heated surface rather than wet it and boil off as steam.

SUMMARY OF THE INVENTION

Briefly described, the present invention is directed to a steam iron soleplate, steam generator and steam distributor subassembly that uses a relatively thin soleplate in combination with a coverplate that is spaced from and supported on the soleplate by a peripheral spaced rib to define a steam distributing passage means therebetween. The coverplate is integrally attached to the soleplate by a continuous weld between the rib and soleplate and the steam generating means is provided directly in the coverplate rather than the soleplate and is connected or ducted to the steam passage means below. The heat generating means is directly in the coverplate and the subassembly is put together by stamping out the soleplate, welding the spaced coverplate completely around its periphery to the soleplate to permanently secure the two together and then the rest of the iron is assembled on this base subassembly. Additional ribs may be used to weld the parts together so that the suspended heating means heats the soleplate primarily by conduction through the ribs to the soleplate and a very large steam conversion and distributing area is provided for maximum steam capacity. Thus, the main object of the invention is to provide a simple steam iron subassembly that is easily put together permanently by welding and comprises very few parts.

DESCRIPTION OF THE PREFERRED EMBODIMENT

The soleplate subassembly described is primarily for use with a steam iron of a typically general type as shown in U.S. Pat. No. 3,188,757 of common assignment in that it may be operated dry or, by operating a well-known water valve to drip water into a generator where it flashes into steam and then is distributed under a coverplate to steam ports in the soleplate in the conventional manner. Closing the water valve provides dry operation and such structure is well-known in the prior art and is not repeated here. Usually the irons employ a rather massive aluminum soleplate to provide a large heat sink and this may be die cast or gravity cast with the soleplate having the heating rod or element cast integrally therein for best even heat distribution on the soleplate. The soleplate of such conventional irons generally runs about a half an inch thick, thinning down in the area of the steam distribution passages to less than a half inch. The steam generator and the soleplate around the heater is the thickest portion generally resulting in about a half inch casting.

Figure 1:
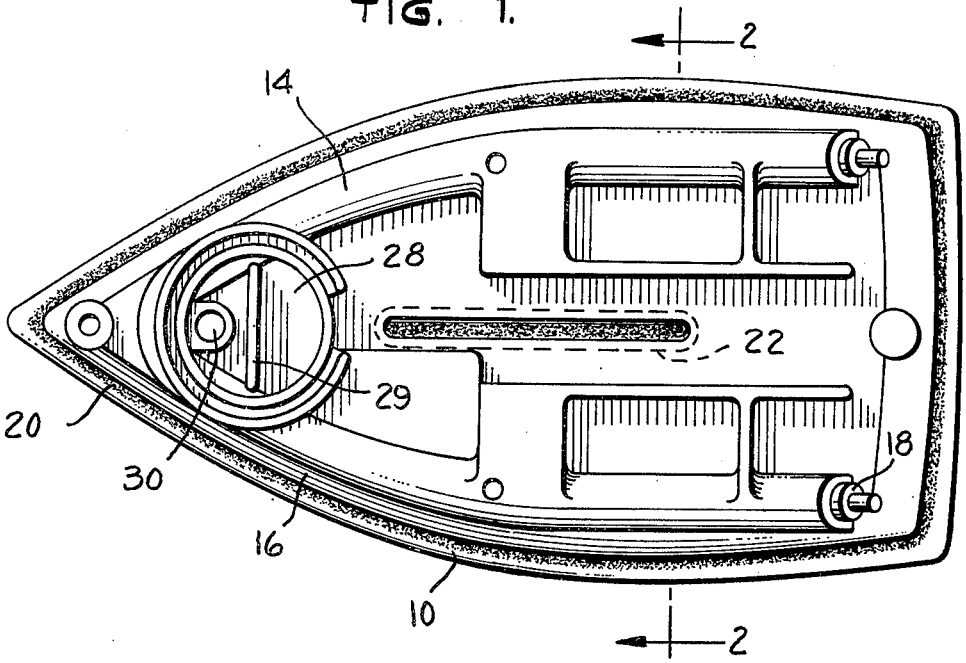
FIG. 1 is a plan view of the soleplate subassembly.

Referring to FIG. 1, there is shown a wrought soleplate 10 to which the present invention is especially applicable. The advantage of wrought material is that it is possible to get alloys of better corrosion resistance than available in the cast soleplates, the wrought material requires essentially no machining, it has no porosity which is a problem in cast soleplates and it is lighter in weight. Additionally, it provides a highly flexible material choice, can be more easily polished, and provides a smoother ironing surface. It can be stamped directly from rolls and can be purchased clad with a variety of materials such as stainless steel, titanium, and polytetrafluoroethylene (better known as Teflon) to provide smoother and more durable ironing surfaces. Thus, the wrought material, whether clad or not, may be brought in large rolls and complete soleplates stamped out of the rolls. The material is ribbon-like in the sense that it is flat material of approximately ⅛ inch or less throughout. This is what is meant by the term "relatively thin" as used in the claims as being different from the normal massive thick cast soleplates.

The soleplate may be formed with suitable steam ports 12 that can be stamped in any suitable number and orientation in the same assembly line in which the soleplates 10 are stamped. Thus, no drilling is required. The ports and edge of the soleplate may also then be coined to provide a finished relatively thin soleplate with or without either stainless steel clad or other suitable coatings.

Figure 2:
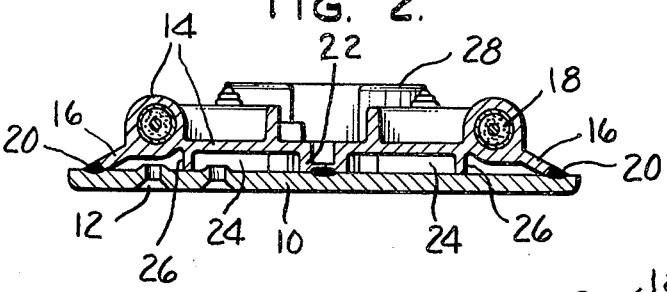
FIG. 2 is a cross-sectional view on the line 2—2 of FIG. 1 showing the spacing arrangement.
Figure 3:
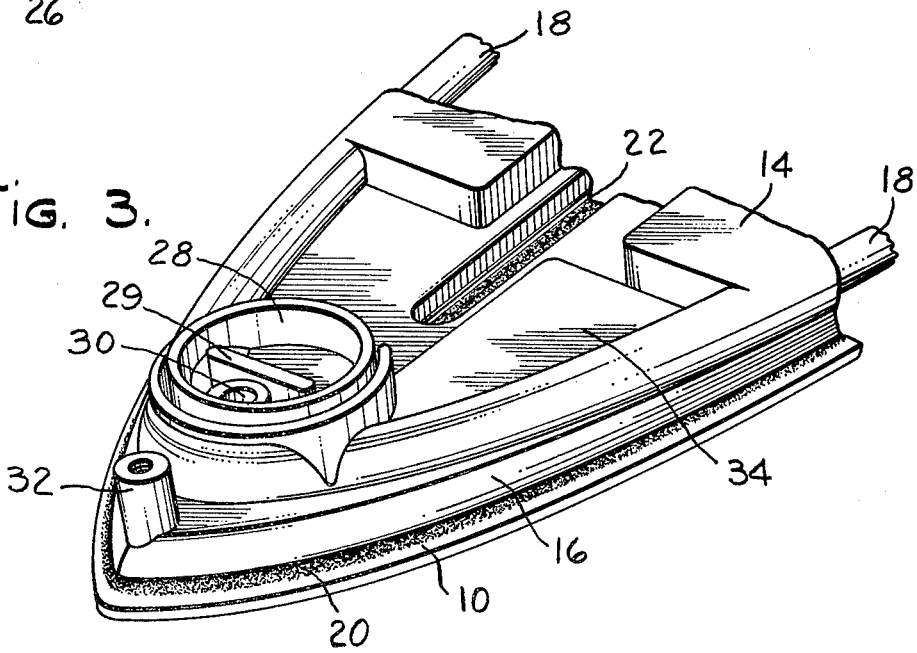
FIG. 3 is a perspective view of the completed subassembly.

In order to provide a simple steam distribution system and provide even heat to the soleplate, a simple formed coverplate 14 is provided. This may be a formed casting that has a continuous depending peripheral rib 16 around the coverplate. Heat is provided by the customary heat generating element or rod 18 that is cast in position directly on the coverplate to form part of the coverplate as shown in FIG. 2. The heating element is generally of the sheath type and normally extends around the soleplate in a loop beginning at the rear of the iron along one side to the forward end and then rearwardly along the other side to enclose the iron except at the rear of the soleplate as shown in FIG. 1. The sheathed heating element has an electrical resistance wire extending through an outer tubular protective sheath with the heating element separated from the outer sheath by an electrical insulating compound resistant to heat such as a mass of granulated and compressed magnesium oxide well-known in the art.

In order to transfer heat from element 18 to the soleplate 10, the peripheral rib 16 is integrally attached to the soleplate, after the desired ports are punched, by a continuous weld 20 completely around the coverplate as shown in FIG. 1. The welding is made by any suitable welding process such as Electron Beam, TIG, MIG, or Laser and the entire periphery is welded to the soleplate to seal the edges of the coverplate to the soleplate. This complete welding eliminates any need for a sealing compound with its tendency to create dri-filming problems since the welding provides an unbroken integral connection between the soleplate and coverplate. Thus, heat transfer to the soleplate from element 18 is primarily by heat conduction through the ribs that space and support the coverplate from the soleplate. In order to stiffen the subassembly, avoid warping, and provide improved support and heat transfer, a central longitudinal rib 22 may be provided and it is also continuously welded to the soleplate in the same manner as shown in FIG. 2. Again, heat transfer through rib 22 is primarily by conduction through the weld to the soleplate so that the combination of the peripheral welded rib 16 and central rib 22 provides for even heating of the relatively thin soleplate. The high heat intensity welding allows the coverplate and soleplate to be joined with no warping or buckling and no local hot spots to separate any cladding material.

For steam distribution in the large distribution chamber 24, additional guide ribs 26 on the bottom of the coverplate can be provided for any suitable labyrinth to distribute steam uniformly to steam ports 12. With the coverplate spaced from the soleplate as shown, a copious steam distribution chamber 24 is provided which, with the suitable guide ribs 26, may direct the steam in any desired path through the soleplate. The arrangement described permits economic application of any number of soleplate surfaces including stainless steel.

Because of the relatively thin light soleplate, it is necessary to generate steam off of the soleplate and this is done by providing a steam generating means in the form of a boiler 28 wholly disposed directly in the upper surface of the coverplate separate and distinct from the usual steam generator in the soleplate. With the construction shown this may be relatively large and in the generally forward portion of the iron as shown in FIG. 1, although its specific location may be other than as shown. Preferably, it is located forward of the longitudinal rib 22 at one end thereof and disposed along the longitudinal center line of the soleplate as is rib 22. Thus, it is symmetrical about the longitudinal center line at the forward end of longitudinal rib 22. Steam generated in the upper surface of the coverplate is disposed to enter distribution chamber 24 by any suitable connection such as directing rib 29 and ducting means 30 to direct the steam down below the coverplate and into large chamber 24 or distributing passage from whence it exits ports 12.

It will be seen that the subassembly is formed by stamping out the soleplate and then punching or coining the steam ports and the edge of the soleplate to round them and smooth them and then placing the cast coverplate in place and welding it continuously around its depending rib to the soleplate to permanently attach it thereto. Thus, a steam distributing chamber 24 is formed and this completed two-part subassembly may then form the base for the rest of the iron components such as attaching at 32. The spaced coverplate provides an ideal shelf or pad 34 on which a thermostat may be mounted in close proximity to the hot portion for sensing the iron temperature.

The present soleplate assembly provides a simple two-part construction where the heat element is embedded, for a maximum heat conduction and maximum heater life, directly in the chamber cover above the relatively thin soleplate. The two parts are welded together at their edges to create heat conduits to the soleplate surface so that heat transfer is primarily by conduction evenly throughout the soleplate. The distribution chamber formed between the parts permits copious steam distribution through any number or orientation of spaced ports punched through the thin soleplate which may be punched directly from rolled alloys and thus permits economic application of any number of surfaces such as stainless steel and a light weight soleplate. The boiler or generator is located directly in the cast coverplate and is of relatively large size to permit complete conversion of water to steam and ample area for mineral deposit storage which means longer iron life. By locating the steam generator in the coverplate rather than the soleplate the invention does not generate a cold spot in the soleplate surface and the large boiler will not flood within standard temperature ranges because of its massiveness and its spacing from the soleplate. Thus, the simple two-piece construction of the subassembly permits all the advantages previously noted.

While there has been described a preferred form of the invention, obvious equivalent variations are possible in light of the above teachings. It is therefore to be understood that, within the scope of the appended claims, the invention may be practised otherwise than as specifically described, and the claims are intended to cover such equivalent variations.

We claim:

1. A steam iron soleplate, steam generator, and distributor subassembly comprising, a relatively thin soleplate, a coverplate spaced from and supported on said soleplate by spaced rib means defining steam distributing passage means therebetween, the coverplate being integrally attached to the soleplate by a continuous weld between the ribs and soleplate, steam generating means in the coverplate connected to said steam passage, and heat generating means forming part of said coverplate, whereby heat transfer is from said generating means to the soleplate through said ribs and weld primarily by conduction therethrough.

2. Apparatus as described in claim 1 wherein said soleplate has a plurality of spaced ports therethrough and the continuous weld extends completely around the periphery of the coverplate.

3. Apparatus as described in claim 2 wherein the spaced ribs comprise a peripheral rib around the entire coverplate and, at least a rib centrally disposed of the coverplate and integrally welded therebetween.

4. Apparatus as described in claim 3 wherein said steam generating means is wholly disposed in the upper surface of the coverplate and ducted below to said steam passage means.

5. A steam iron soleplate, steam generator, and distributor subassembly comprising, a relatively thin wrought soleplate having a plurality of steam ports therethrough, a coverplate having a continuous peripheral depending rib therefrom and a continuous weld between said rib and soleplate integrally attaching the coverplate in spaced relation on said soleplate and defining steam distributing passage means therebetween, said coverplate having depending longitudinal rib means continuously welded to the soleplate, steam generating means in the coverplate separate and distinct from the soleplate, a heat generating element forming part of the coverplate and extending therearound adjacent the periphery except at the rear of said soleplate, whereby heat transfer is from the generator means to the soleplate through said ribs and weld by conduction.

6. Apparatus as described in claim 5 wherein said longitudinal rib is disposed along the longitudinal centerline of the soleplate.

7. Apparatus as described in claim 6 wherein the steam generating means is symmetrical about the longitudinal centerline at one end of the longitudinal rib means.

8. Apparatus as described in claim 7 wherein the steam generator is disposed on the upper surface of the coverplate and ducted below to said steam distributing passage means.

* * * * *